US007086992B2

(12) United States Patent
Bowman et al.

(10) Patent No.: US 7,086,992 B2
(45) Date of Patent: Aug. 8, 2006

(54) POSTURE CORRECTION EXERCISE DEVICE

(76) Inventors: Jason Bowman, 9420 8th Ave., Pleasant Prairie, WI (US) 53158; Robert Gearhart, 604 River Bluff Dr., Carpentersville, IL (US) 60110; Robert L. Richardson, 201 5th Ave., Marengo, IL (US) 60152

( * ) Notice: Subject to any disclaimer, the term of this patent is extended or adjusted under 35 U.S.C. 154(b) by 105 days.

(21) Appl. No.: 10/964,937

(22) Filed: Oct. 14, 2004

(65) Prior Publication Data

US 2005/0079957 A1 Apr. 14, 2005

Related U.S. Application Data

(63) Continuation-in-part of application No. 10/393,332, filed on Mar. 20, 2003, now Pat. No. 6,997,857.

(51) Int. Cl.
*A63B 71/00* (2006.01)

(52) U.S. Cl. ..... 482/51; 482/142

(58) Field of Classification Search ..... 482/51, 482/142, 148, 907; 272/130–134
See application file for complete search history.

(56) References Cited

U.S. PATENT DOCUMENTS 4,500,089 A 2/1985 Jones
5,037,090 A * 8/1991 Fitzpatrick ..... 482/112
5,100,131 A 3/1992 Fong
5,256,126 A 10/1993 Grotstein
5,288,130 A 2/1994 Foster
5,487,714 A * 1/1996 Ferrari ..... 482/123
5,496,247 A 3/1996 Anderson
5,599,261 A 2/1997 Easley et al.
5,833,590 A 11/1998 Chiu et al.
6,022,303 A * 2/2000 Abdo ..... 482/140
6,059,701 A 5/2000 George et al.
6,213,923 B1 4/2001 Cameron et al.
6,248,047 B1 6/2001 Abdo
6,312,366 B1 11/2001 Prusick
6,602,171 B1 * 8/2003 Tsen et al. ..... 482/140
6,746,384 B1 * 6/2004 Cole et al. ..... 482/130

* cited by examiner

*Primary Examiner*—Lori Amerson
(74) *Attorney, Agent, or Firm*—Levenfeld Pearlstein; Leon I. Edelson

(57) ABSTRACT

A posture correction exercise device is disclosed to aid in correcting the common postural condition of kyphosis-lordosis by aiding in the exercise of the spinal erectors to strengthen the erectors to pull the user's spine and torso backward into normal alignment and by exercise of the mid-trapezious, rhomboid and posterior deltoid muscles to strengthen these muscles to pull the user's shoulder blades together and force the shoulders into normal alignment. The device operates by seating the user upon a declined seat to provide increased resistance by gravity. The device provides resistance to backward movement of user's body and resistance to backward rotation of user's arms. The hands of the user are positioned in supinated palms-up hand positions to increase the training effect of the backward rotation of the user's arms.

11 Claims, 3 Drawing Sheets

POSTURE CORRECTION EXERCISE DEVICE

CROSS REFERENCE TO RELATED APPLICATIONS

Continuation-in-part of application Ser. No. 10/393,332 filed Mar. 20, 2003 now U.S. Pat. No. 6997,857.

BACKGROUND OF THE INVENTION

1. Field of the Invention

This invention relates to a posture correction exercise device. The device is designed to operate to correct postural faults related to abnormal backward curvature of the spine (kyphosis) coupled with abnormal forward curvature of the spine (lordosis). The posture correction exercise device aids in restoring proper spinal alignment by aiding in the exercise of the spinal erectors to strengthen the erectors to pull the spine and torso backward into normal alignment and by the exercise of the mid-trapezious, rhomboids and posterior deltoid muscles to strengthen these muscles to pull the shoulder blades together, thereby forcing the shoulders into normal alignment.

2. Description of the Prior Art

The prior art describes many types of exercise apparatus designed to exercise specific muscles, muscle groups or areas of the body.

For example, U.S. Pat. No. 6,312,366 to Prusick discloses an exercise device to exercise the abdominal and lower back muscles wherein the user sits on a generally horizontal seating surface and utilizes a resilient upright member from the rear of the seating surface to provide exercising resistance for the lower back when pressure is exerted against it by the user's upper back, and resistance to the abdominal muscles when pressure is exerted forward by the user by bending forward. U.S. Pat. No. 6,213,923 to Cameron, et al., discloses an adjustable chair which may be declined at varying angles by a user wherein the angle of decline and amount of resistance to movement of the chair is controlled by the user. The user pushes backward against the chair resistance to effect back exercises to strengthen the muscles of the lower back and abdomen. The U.S. Pat. No. 6,059,701 to George, et al., teaches an apparatus for exercising the muscles of the lower back wherein the user kneels upon a pad and leans forward with his upper back engaged with the back pad of a lever for a resistance arrangement of weight elements. As the user bends backward the user's back presses against the lever, causing the weight elements to be lifted, thus providing resistance to the spinal erector muscles.

U.S. Pat. No. 5,599,261 to Easley, et al., and 5,256,126 to Grotstein disclose exercise devices directed to exercising abdominal and lower back muscles. Easley '261 discloses a device wherein the user sits upon a seat, grips hand grips and bends forward against resistance to exercise the abdominal muscles and bends backward against resistance to exercise the lower back muscles. Grotstein '126 discloses a frame upon which the user sits and leans forward or backward against resistance to exercise the abdominal or lower back muscles.

Exercise devices for exercising lower back muscles are disclosed by Foster, U.S. Pat. No. 5,288,130, and Jones, U.S. Pat. No. 4,500,089. Foster '130 discloses an exercise chair designed to provide stabilization of the pelvis during exercise for the lower back to isolate the lumbar region from powerful leg muscles in order to exercise muscles of the trunk. Jones '089 discloses a device with a saddle-type seat for the user in up-right position. A padded roller connected with weights provides variable resistance for lifting and lowering the weights.

Chiu, et al., U.S. Pat. No. 5,833,590, and Fong, U.S. Pat. No. 5,100,131 disclose stretching exercise devices for back muscles exercising and stretching. Chiu '590 discloses a base frame on which the user sits and leans backward and forward against resistance. Fong '131 discloses a stationary seat on which the user sits and a backrest. The user presses against resistance of the backrest by pressing backward or forward. The stretching of both Chiu '590 and Fong '131 is accomplished by leaning backward upon a back rest.

Anderson, U.S. Pat. No. 5,496,247, discloses an exercise bench for strengthening the muscles of the lower back by having a seat mounted to an inclined beam and a knee brace mounted to the beam. The user bends forward and backward against the angle of the incline. Abdo, U.S. Pat. No. 6,248,047, discloses an exercise device having a support frame, a tension assembly comprising a resilient member mounted at the top of the upright support and engaging two arm positions, a resilient upright and two arm positioners. Easley, U.S. Pat. No. 5,599,261, teaches in FIG. 10 an inclined frame (30).

However, the above exercise devices are designed to strengthen abdominal and lower back muscles as is taught by Abdo, and a group of abdominal muscles and a group including the lower back, glutens and quadriceps muscles as taught by Easley. The instant invention is designed to aid in restoring proper spinal alignment by aiding in the exercise of the spinal erectors and by exercise of the mid-trapezious rhomboids and posterior deltoid muscles to strengthen these muscles to pull the shoulder blades together, thereby forcing the shoulders backward together to correct postural faults related to kyphosis and lordosis.

As described in the prior art, many available home or gym exercise devices/programs focus on improving one's health by way of building muscle and/or burning fat. Improvement in the shape and composition of one's body leads to better overall health. However, beyond building muscle and burning fat, the maintenance of good posture is an essential aspect of overall health overlooked by mainstream fitness. The posture exercise device satisfies a need for an affordable, easy-to-use, at-home treatment for poor posture or maintenance of good posture.

In explanation of the use of the posture correction exercise device, posture is essentially the position of the body in space. Optimal posture is the state of muscular and skeletal balance that protects the supporting structures of the body against injury or progressive deformity, whether at work or rest. Correct posture involves the positioning of the joints to provide minimum stress on the joints of the body. Posture also involves the chain-link concept of body mechanics in which problems anywhere along the body chain can lead to problems above or below that point. For example, knee pain can arise from pelvic joint disorders. Proper posture:

- Keeps bones and joints in the correct alignment so that muscles are being used properly.
- Helps decrease the abnormal wearing of joint surfaces that could result in arthritis.
- Decreases the stress on the ligaments holding the joints of the spine together.
- Prevents the spine from becoming fixed in abnormal positions.
- Prevents fatigue because muscles are being used more efficiently, allowing the body to use less energy.
- Prevents strain or overuse problems.

Prevents backache and muscular pain.

Contributes to good appearance.

The causes of the abnormal postural alignments are shown to be of two categories: positional and structural. Structural causes are basically permanent anatomical deformities not amenable to correction by conservative treatments. Positional causes of poor posture include:

Poor postural habit—occurs when an individual does not maintain a correct posture, due to various reasons: pregnancy, high-heeled shoes, poor work environment, poor sitting and standing habits, Psychological factors, especially self-esteem, Normal developmental and degenerative processes, Pain leading to muscle guarding and avoidance postures, Muscle imbalance, spasm, or contracture, Respiratory conditions, General weakness, Excess weight, Loss of proprioception—the ability to perceive the position of the body.

The symptoms of kyphosis-lordosis thus arise for many reasons. The most common of which are poor postural habits, lack of body awareness, inherent anatomical imbalances, overweight and ineffective or non-existent exercise. A typical scenario involves a person who spends much of their waking hours in a seated (slouched) position either while driving or at work, either at home or at the office. While seated or standing, tasks are performed in front of the face (through no fault of their own). Front working muscles may become stronger and tighter if not stretched, while non-working muscles will lengthen. Body awareness is lost through habitual front activities as the person "forgets" proper alignment. If counter-balance measures are not taken, form will follow function as posture alignment migrates forward. When these habits are combined with the inevitable effect of gravity, which serves to "weigh down" the spine over time (because most body weight is located in front of the spine) the alignment is pulled forward and pushed down. Eventually outward appearance suffers and health problems may ensue.

In further explanation as to the conditions of kyphosis-lordosis, kyphosis-lordosis is an increase in the normal inward curve of the low back, accompanied by a protruding abdomen and buttocks, increased flexion (outward curve) of the thoracic spine, rounded shoulders and a forward-tilted head. Many faulty postural conditions (70–80%) are of this nature.

The conditions of kyphosis-lordosis are not inevitable since muscles work in opposites (agonist/antagonist). If one muscle is contracted the opposite muscle must relax to allow the movement to occur. For example, if the biceps contracts around the elbow to perform an arm curl, the tricep must relax. Likewise, if one muscle is tight, the opposite muscle will become loose. The biomechanic conditions responsible for a kyphosis-lordosis condition are:

neck in a constant flexed (forward) position causes musculature adjoining in front (neck flexors) to tighten and pull the head/chin forward. They will maintain that position until stretched, allowing a return to normal alignment neck in a constant flexed (forward) position causes musculature adjoining in back (cervical extensors & trapezius) to lengthen, allowing the neck and head to lean forward. They will maintain that position until strengthened, forcing a return to normal alignment.

shoulders in a constant flexed (forward) position causes musculature adjoining in front (deltoid and pectoral muscles) to tighten and pull the shoulders forward. They will maintain that position until stretched, allowing a return to normal alignment.

shoulders in a constant flexed (forward) position causes musculature adjoining in back (mid-trapezius, rhomboids, deltoids,) to lengthen, allowing the shoulders to rotate forward in rested position. They will maintain that position until strengthened, forcing a return to normal alignment.

trunk muscles in a constant flexed position cause muscular adjoining in front (abdominals/obliques) to tighten and pull the trunk forward. They will maintain that position until stretched, allowing a return to normal alignment trunk muscles in a constant flexed (forward) position cause muscular adjoining in back (spinal erectors) to lengthen, allowing the trunk to lean forward. They will maintain that position until strengthened, forcing a return to normal alignment a hip in a constant flexed (forward) position causes musculature adjoining in front (hip flexors) to tighten and pull the hips forward. They will maintain that position until stretched, allowing a return to normal alignment.

a hip in a constant flexed (forward) position causes musculature adjoining in back (hip extensors) to lengthen, allowing the hips to tilt forward. They will maintain that position until strengthened, allowing a return to normal alignment.

Six corrective therapies are conventionally employed in combination for the conventional treatment of kyphosis-lordosis postural faults: heat; massage (with possible chiropractic manipulation); stretching; strengthening exercises; supportive measures (braces) to treat ligaments, bones, and nerves; and education.

An object of this invention is to provide a posture correction exercise device effective in treatment of kyphosis-lordosis postural faults by aiding the restoration of proper spinal alignment through three separate biomechanical exercises consisting of (1) extension of the lumbar region of the body against resistance, (2) contraction of the mid-trapezious, rhomboid, posterior deltoid muscles against resistance, (3) stretching of the neck flexor muscles, the trunk abdominal muscles, trunk abdominal oblique muscles, and (4) the pectorales (chest) muscles, the anterior deltoid (shoulder) muscles are also stretched by exercise of the user's body occasioned by use of the posture correction exercise device.

It is an object of this invention to provide a posture correction exercise device specifically directed to correction of kyphosis-lordosis postural faults by exercising, strengthening and stretching the muscles of the body significant in correcting the conditions of kyphosis and lordosis.

It is an object of this invention to provide a posture correction device to exercise and strengthen the spinal erectors to pull the spine and human torso backward into normal alignment to aid in correction of a condition of lordosis.

It is an object of this invention to provide a posture correction device to exercise, tone, strengthen the mid-trapezious, rhomboid and posterior deltoid muscles to pull the shoulder blades of the user together against resistance to force the shoulders into normal alignment to aid in correction of a condition of kyphosis.

It is an object of this invention to provide a posture correction device to exercise, tone and strengthen the spinal erectors to pull the spine and torso backward into normal spinal alignment, to tone and exercise the mid-trapezious, rhomboid and posterior deltoid muscles to pull the shoulder blades together of the user to force the shoulders into normal alignment and the head into a forward position to complete spinal realignment with suitable stretching exercises accomplished through separate stretching strategies to aid in correction of the condition of kyphosis-lordosis.

BRIEF SUMMARY OF THE INVENTION

A posture correction exercise device is disclosed to aid in correcting the common postural condition of kyphosis-lordosis by aiding in the exercise of the spinal erectors to strengthen the erectors to pull the user's spine and torso backward into normal alignment and by exercise of the mid-trapezious, rhomboid and posterior deltoid muscles to strengthen these muscles to pull the user's shoulder blades together and force the shoulders into normal alignment. The device operates by seating the user upon an inclined seat to provide increased resistance by gravity to backward movement of user's body and backward rotation of user's arms against a tension elastomer-loaded assembly mounted on the resilient spring-loaded upright support and resistance against tension provided by a cushion back roller pad assembly and said resilient spring-loaded upright support against backward movement by the user's body wherein hands of the user are positioned in supinated palms-up hand positions by grasping hand grips affixed at a 45 degree angle to arm positioners of the device at the exterior ends of the arm positioners.

DETAILED DESCRIPTION

Figure 1:
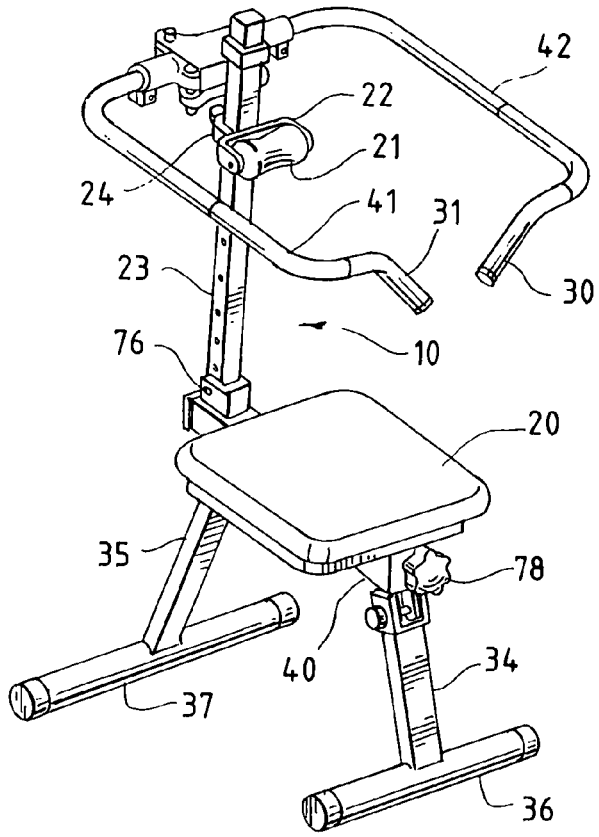
FIG. 1 is a perspective view of a first embodiment of the invention.
Figure 2:
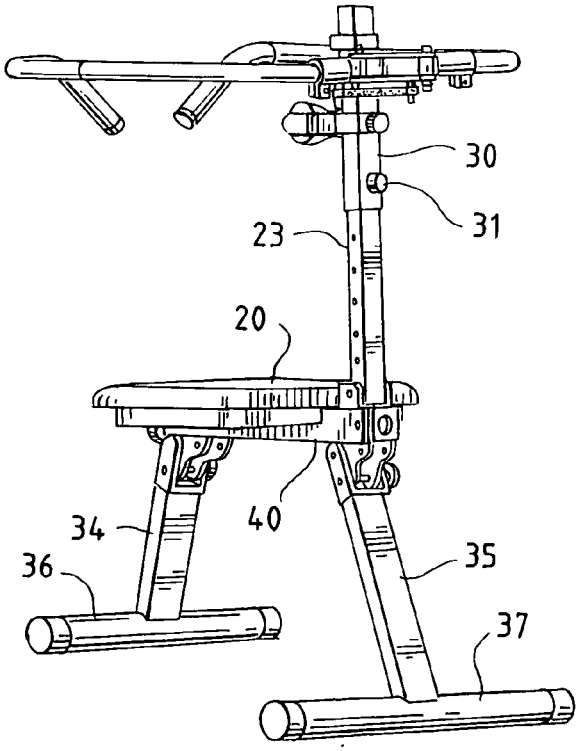
FIG. 2 is an inclined back view of a first embodiment of the invention.

The posture correction device for correcting kyphosis and lordosis conditions includes:

(a) an inclined support main frame, (b) a seat suitably mounted on said inclined support main frame to position user in an upright stance with the user's chest positioned forward upon said exercise device, (c) a resilient spring-loaded elongated upright support with means of providing tension with a suitable adjustable range of motion to provide adjustable tension for the user against backward movement of the user's body against said resilient spring-loaded elongated upright support to provide lumbar muscle extension, (d) an affixed cushion roller pad as a back support, (e) two rearward rotational arm assemblies for support and positioning of the user's arms for rearward rotation to provide mid-trapezious/rhomboid/posterior deltoid muscle contraction.

The two rearward rotational arm assemblies are operational rearward within a range of up to 80 degrees, against resistance by the user facing forward. Two downward positioned hand grips on exterior ends of two arm assemblies mounted as downward bent sections of said two arm assemblies guide and provide a grip for user's hands in supinated palms-up hand position. A tubular carrier has an affixed bracket slidably mounted on upward end of said tubular upright support member. The tubular carrier supports two arm assembly housings with downward projecting fingers for attachment of resilient elastomer members to provide tension to the two arm assemblies to create resistance to rearward motion of the two arm assemblies. An adjustable positioning support including a cushion roller and a movable positioning bracket provide height adjustment of said cushion roller.

Referring to FIGS. 1–7, there is shown a preferred first embodiment of exercise device 10 suitable for accommodating a user in a seated position. Exercise device 10 has an inclined base frame 40 supporting the padded seat 20 and resilient spring-loaded elongated upright support 23 supporting arm assemblies 41 and 42. Arm assembly housings 28 and 29 and tension elastomer band 27 engage arm assemblies 41 and 42. Tension elastomer band 27 is stretched to provide resistance for rear-ward rotation of arm assemblies 41 and 42. Tension elastomer band 27 is of a resilient elastomer material selected from the group consisting of neoprene rubber, butyl rubber, silicone rubber and any synthetic elastomer suitable for the resilient reqirements of providing a suitable resilient range of motion of the two arm assemblies of up to a range of at least 120° for each arm assembly backward. Exercise device 10 inclined base frame 40 has inclined vertical support legs 34 and 35 with attached horizontal cylindrical footing 36 and 37. Arm assemblies 41 and 42 are mounted on spring-loaded upright support 23 by arm assembly housings 28 and 29 seated in arm assembly housings bracket 11, adapted to seat arm assembly housings 28 and 29 within the bracket arms, said arm assembly housings 28 and 29 being affixed to said bracket. Coil spring assembly 60 within base frame 40 serves to spring-load up-right support 23 to provide resistance to backward movement of arm assemblies 41 and 42 mounted on spring-loaded up-right support 23.

The inclined base main frame 40 is inclined at an angle of approximately 10–25° relative to the horizontal. The angle of inclination is chosen to increase the muscular activity required for moving the user's body from a forward leaning position to a backward leaning position and thus to exercise the spinal erectors to strengthen the erectors and mid-trapezious, rhomboid and posterior deltoids to pull the spine and torso backward. An angle ranging from about 10° to about 25° is considered to be useful for this purpose and provide effective muscular exercise. The angle of 10–25° plus and minus about 50° has been chosen as providing sufficient muscular exercise to the user that the user will stay with the program to correct postural faults and reach their objective without experiencing the loss of initiative as compared to many exercise programs. However, an angle greater than about 35°, to about 45° can decrease the user's sense of balance. The angle of 10–25° is considered to be preferable.

Figure 3:
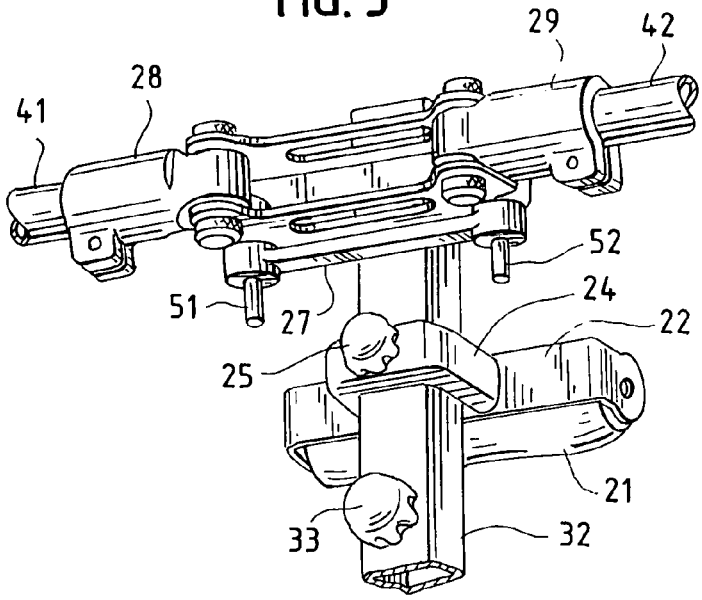
FIG. 3 is a front view of the two arm assembly housings, each arm assembly housing with a downward projecting finger to retain elongated elastomer members, and showing portions of supporting arm assemblies.
Figure 4:
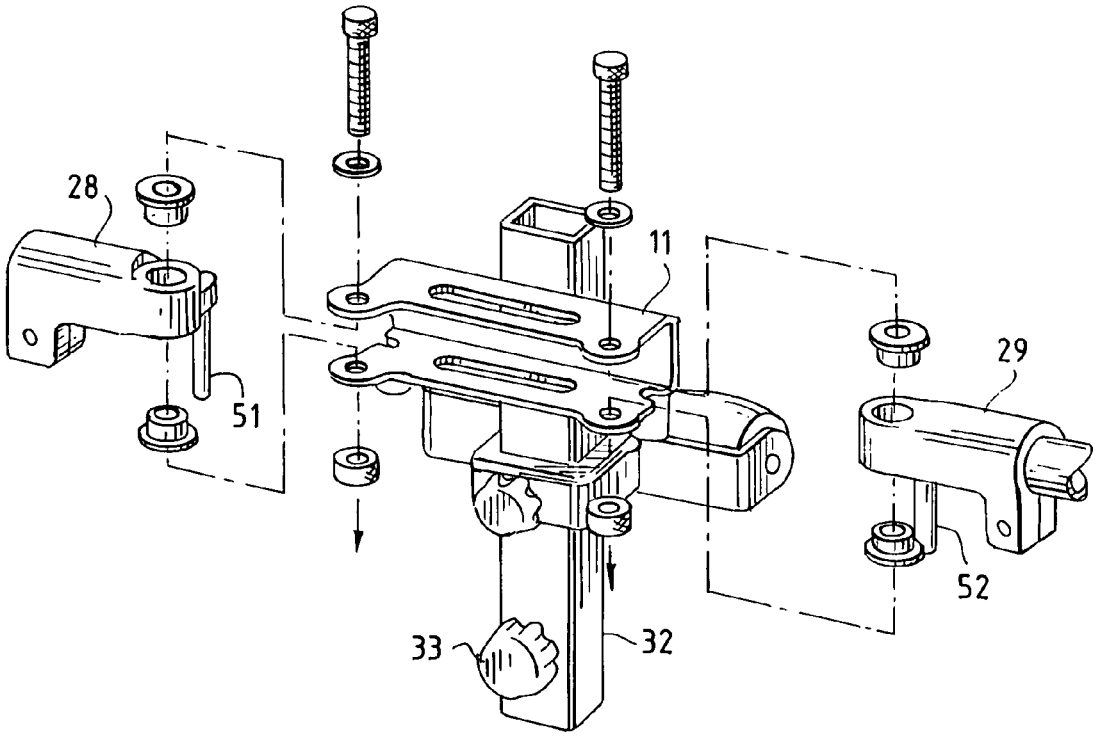
FIG. 4 is an exploded view of the U-shaped bracket and two arm assembly housings.
Figure 5:
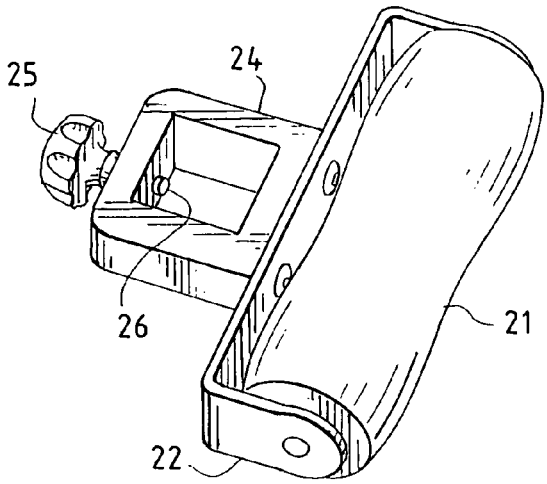
FIG. 5 is a view of the cushion roller pad.

A seat member 20 is affixed to the top surface of the inclined support main frame 40. A cushion roller pad assembly comprises padded and cushion backrest 21 affixed to upright support 23 by bracket 22 and backrest carrier 24. Backrest carrier 24 has an adjusting screw knob 25 with adjusting finger 26 to lock carrier 24 in position on upright support 23. Spring-loaded upright support 23 supports arm assemblies 41 and 42 affixed to spring-loaded upright support 23 by bracket 11 and arm assembly housings 28 and 29. Arm assemblies 41 and 42 are shaped in accordance with the user's arms to accommodate the user to grasp hand grips 30 and 31 in a palms-up position, in a supinated hand position. Arm assembly housing bracket 11 and backrest carrier 24 are mounted on slidably mounted support carrier 32. Support carrier 32 has an adjusting screw knob 33 with an adjusting finger (not shown) to affix rectangular support carrier 32 in position on upright support 23 as required by the user. Hand grips 30 and 31 are angled at about 45° downward, plus or minus 5°, to allow the user to comfortably grasp the hand grips 30 and 31 in a position facilitating the supinated hand position. The elastomer-loaded arm assembly housings 28 and 29 shown in FIGS. 3 and 4 provide tension against backward rotation of the user's arms by tension elastomer band member 27 of a resilient elastomer which engages the two arm assembly housings 28 and 29 projecting fingers 51 and 52 to provide resistance to backward rotation of the two arm assemblies 41 and 42. The tension elastomer band member 27 of a resilient elastomer is selected from plastic material of sufficient resiliency to provide sufficient resistance to movement of the arm assemblies in rearward motion. Replaceable tension elastomer band member 27 of varying resiliency provides means of adjusting the tension of the arm housing assemblies 28 and 29. The tension elastomer band member 27 can comprise one or more resilient members for adjustment of resistance and tension.

Figure 6:
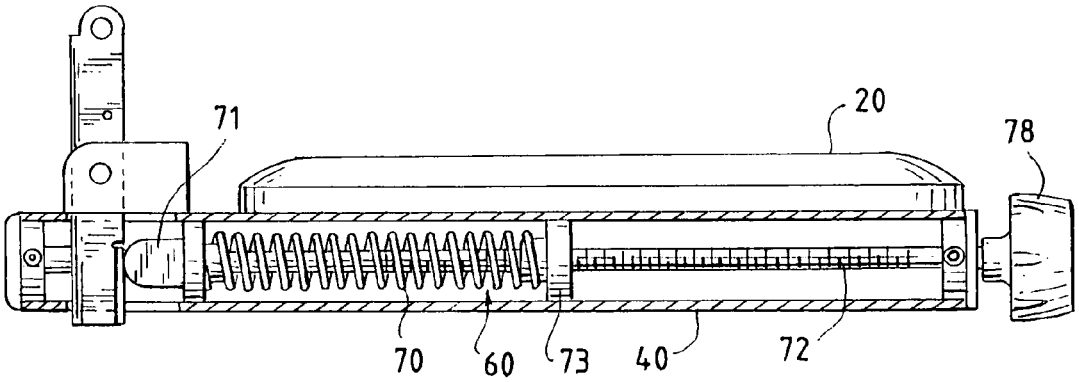
FIG. 6 is a side view of the coil spring assembly embodiment.
Figure 7:
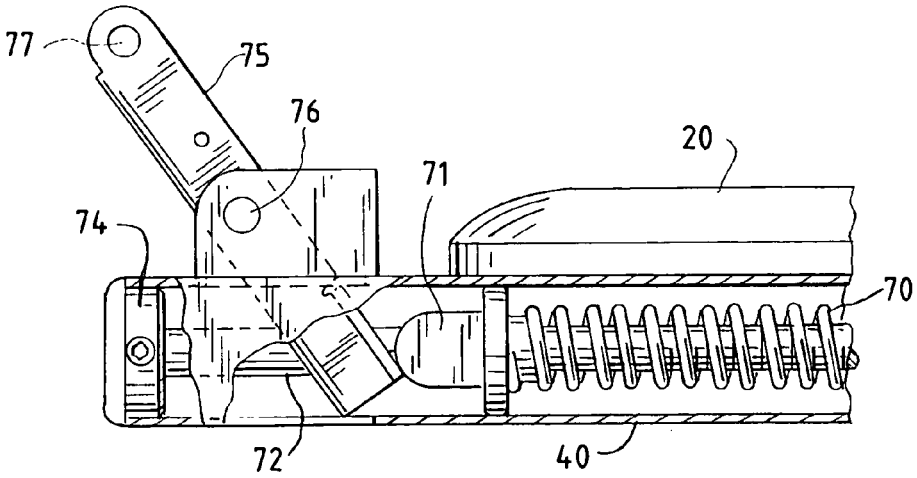
FIG. 7 is a side view of the spring assembly showing the coil spring engaging the pivot lever extension of the upright support.

The coiled spring assembly 60, as shown in FIGS. 6 and 7, is mounted within the base frame 40 upon which seat member 20 is affixed. Coil spring assembly 60 comprises compression spring 70, push block 71, threaded shaft 72, nut block 73, back plate 74, pivot lever member 75, pivot axis bolt 76, engaging member bolt 77 which engages pivot lever member 75 to spring-load upright support 23. Adjustment of coil spring 70 is by rotation of compression spring adjustment knob 78.

An alternative embodiment (not shown) of the posture correction device permits the device to be folded for storage. The alternative embodiment has removable locking pins in the arm housing assemblies 28 and 29, in the base of the spring-loaded upright support 23 and in the mounting of the support legs 34 and 35 to the inclined main frame. Upon removal of the locking pins, the device folds flat for storage.

With regard to means for fastening, mounting, attaching or connecting the components of the present invention to form the exercise device 10 as a whole, unless specifically described as otherwise, such means are intended to encompass conventional fasteners, such as machine screws, rivets, nuts and bolts, toggles, pins and the like such as shown in FIG. 4 which illustrates use of bolts, nuts, washers and similar articles as assembly devices. Unless specifically otherwise disclosed or taught, materials for making the components of the present invention are selected from appropriate materials such as aluminum, steel, metallic alloys, various plastics, and vinyls or the like. The inclined support frame can be of tubular construction materials for lightness of weight, and alternatively of solid construction of other than of tubular materials. The upright support can be a steel upright support and, alternatively, can be of a suitable plastic material which provides upright support.

Referring to FIGS. 1–7, in order to properly use the present invention to exercise in the present embodiment, the angular formed body support of inclined base frame 40 provides support which supports the exerciser in a leaning forward position with his upper body supported by his downwardly positioned legs. The user's arms are raised in front of the user, perpendicular to the user's torso with the hands in palms-up position gripping the angled hand grips 30 and 31 of the arm assemblies 41 and 42. Positioning of back rest 21 is alternatively adjusted using carrier screw knob 25 of carrier 24 and associated finger 26 to retain the back rest in position on upright support 23. The mid-back of the user is flush against the cushion back rest 21. The user's torso leans forward.

The spring-loaded upright support 23 mounted on the inclined support frame has a suitable and adjustable range of motion of up to 40° backward from perpendicular to the inclined support frame 40. The tension elastomer band is a removable (and hence adjustable) elastomer 27 mounted at the top end of said spring-loaded upright support 23 and engaging two arm assemblies 41 and 42 against pressing resistance movements of the user's arms. The two arm assemblies 41 and 42 are operated against resistance provided by the tension elastomer band 27 in a suitable resilient range of motion of the two arm assemblies 41 and 42 of up to a range of at least 120° for each arm assembly backward, each arm assembly having a hand grip for the user's hands to grip in supinated palms up position. The spring-loaded upright support 23 is mounted upright as perpendicular to the angle of the inclined support frame. The angle of said inclined seat is in the range of 10–25°, plus and minus 5°, relative to the horizontal. The spring-loaded upright support 23 can be a steel upright support and, alternatively, can be a plastic upright support of any suitable plastic material. The plastic material can be selected from the group consisting of nylon, polycarbonate, polystyrene or any synthetic polymer suitable for the support requirements. The plastic material can be glass-reinforced to aid strength and resilience.

To begin movement, the user will simultaneously lean backward (lumbar extension) through a backward range of motion of up to 40° by pressing backward with force through the user's legs and feet, forcing the user's mid-back into back rest position through a 40° angle while rotating arms and shoulders rearward with both hands grasping the hand grips 30 and 31 (mid-trapezious, rhomboids, posterior deltoid muscles contraction). The movement will finish with the backward lean of the user's torso to roughly 40° (complete contraction of spinal erectors) and rearward rotation of the user's arms from forward position to parallel with the top of the backrest forming a "T" shape (complete contraction of mid-trapezious, rhomboid, posterior deltoid muscles).

Adjustment of the tension of the spring loaded upright support 23 to adjust the lumbar extension force and the tension of the tension elastomer band 27 to adjust the mid-trapezious, rhomboid, deltoid muscles contraction force is by the adjustment of the coil spring assembly 60, by adjustment of the spring adjustment knob 78, and by replacing the tension elastomer band 27 with a suitable elastomer replacement of one or more tension elastomer bands.

In one method of using the posture correction exercise device of the first embodiment, the 10–25° angle of the seat position from the horizontal allows the user with his arms in position to sit on the exercise device from a semi-standing position with knees bent and feet flat on the floor. From a semi-standing position, the user's body weight through the feet and gluteus muscles will stabilize the user's torso during the motion. Since the user can be bending backward from a semi-standing position against a backrest to as much as 40° from the horizontal, stabilization of the user's body is not necessary.

Additionally, the inclined 10–25° plane of the support main frame 40 is conducive to seating forward with the user's arms and hands in position specific to the height of the user. A steeper angle would decrease the effect of body weight for stabilization. The 10–25° angle is conducive to a slight forward anterior tilt of the pelvis of the user as the arms are rotated backward at the end of an exercise motion. The pelvic tilt by the user aids in achieving isolation of the spinal erectors without use of other devices. The slight pelvic thrust forward by the user leaning backward creates a concavity of the user's back by extension of the spine with tension provided between the shoulder blades by tension elastomer band 27 and the supinated position of the hands upon the hand grips 30 and 31.

The 10–25° angle of the inclined support main frame 40 sets the angle of upright support 23 and cushion back rest 21 at a 10–25° angle to the horizontal to allow at least a 10–25° range of motion for the back extension of the user's backward motion. Additionally, upright support 23 and cushion back rest 21 can restrain a forward movement by the user with the user's arms and hands in position from the 40° angle to the horizontal under tension by the tension elastomer band 27.

The utility of the arm assemblies 41 and 42 and shape of the arm assembly arms, shaped to accommodate the user's arms to cause the user to grasp the hand grips 30 and 31 in a palms-up supinated position, is that with the user's arms extended in front and hands in the supinated position, the user's forearms are extended and elbows are pointed downward. As the arms are rotated backward in a range of motion of up to 120°, the elbows remain pointed downward. In this position, the shoulders are rotated backwards in an external rotation. As the motion by the user continues, the shoulders rotate downwards because of the movement of the scapula shoulder blades which are simultaneously moving together in an adduction movement and downward in a retraction movement. In the finished movement, the user's palms are up, the user's shoulders are downward and backward and the user's chest is elevated in a correction of the kyphosis-lordosis condition to train the user's muscles in the position for good posture.

Failure of palms to be supinated position, that is, to be in pronated or neutral positions diminishes the likelihood of achieving the correction of the kyphosis lordosis condition and of training the body muscles in the position of good posture. Unless the user's palms are not supinated in a palms up position, the upper trapezious muscles tend to "take over" when the arms are rotated backward, forcing the shoulders to go upward and forward instead of downward, thus losing the training effect of the exercise of the backward rotation of the user's arms.

Additionally, a consequence of the shoulders moving upward and forward, because the user's palms are not in a supinated position, is that as the shoulders move forward, the user's arms will rotate, the arms are still rotating backward. However the position (angle) of the arms changes (the elbows are out and up) medially toward the middle of the body along the vertical axes in a standing position and the user's hands will follow to a pronated palms facing backward position.

In use, the posture correction exercise device aids in restoring proper spinal alignment through three separate biomechanical actions:

1. Lumbar extension:
   The backward (40°) lean of the torso into the resistance of the back roller and adjoining upright support member exercises the spinal erectors. These muscles under the condition of kyphosis-lordosis are weak and lengthened. When strengthened, the erectors will pull the spine and torso backward into normal alignment.
2. Mid-trapezious/rhomboids/posterior deltoids contraction:
   The rotation of the arms and shoulders from a forward position (palms-up); backward into parallel with the back rest guided by hand grips into resistance afforded by the elastomer assembly serve to exercise the mid-trapezious, rhomboid and posterior deltoids. These muscles under the condition of kyphosis-lordosis are weak and lengthened. When strengthened, they will pull the shoulder blades together forcing the shoulders into normal alignment.
3. Stretching:
   Proper stretching of the neck (flexors), pectoral (chest) and shoulder (front) muscles, trunk (abdominals, obliques) and aid in realignment of the spine and shoulders.
4. When the torso and shoulders are pulled back, the head (in a forward position) will follow suit completing total spinal realignment.

Use of the posture correction exercise device offers an affordable easy-to-use alternative to aid in the postural rehabilitation of the most common form of misalignment (kyphosis-lordosis). It is believed that use of the device for just minutes a day at a frequency of 3 times a week should prove sufficient in correcting most problems. Given the high frequency of failure of most exercise programs; the posture correction device (although not a significant muscle building or fat-burning device) offers a high return on overall health considering the limited amount of time invested. Therefore, users are more likely to stay with the program and reach their goals when compared to another fitness pursuit.

What is claimed is:

1. A posture correction exercise device for correcting kyphosis-lordosis conditions including (a) an inclined main frame having a rearward end and a forward end comprising a single elongated structural member with cross bars and an upright bracket mounted on the rearward end of said single elongated structural member, (b) a seat cushion having a rearward end and a forward end affixed to said inclined main frame wherein position of said rearward end of said seat cushion is spaced apart from said upright bracket on said inclined main frame, (c) an elongated upright support member having a lower end and an upper end extending generally upward from said upright bracket mounted on said rearward end of said elongated structural member, (d) an axis mounting for affixing said lower end of said elongated up-right support member to said upright bracket mounted on the rearward end of said single elongated structural member, (e) a coil spring assembly having a rearward end and a forward end extending generally within said single elongated structural member from said forward end of said single elongated structural member to said rearward end wherein said rearward end presses against end of said elongated upright support member and causes resistance against backward movement of said elongated upright support member upon said axis mounting, and wherein said coil spring assembly and said elongated upright support member comprise a spring loaded elongated upright support member, (f) a support carrier member slidably mounted on said elongated upright support member with a locking finger and adjusting knob, (g) an arm assembly bracket mounted on said support carrier member on said elongated loaded support member, said arm assembly bracket being a U-shaped bracket adapted to seat arm assembly housings within arms of said U-shaped bracket, (h) a right arm assembly and a left arm assembly, each arm of each said arm assembly shaped in accordance with the user's arms, (i) two elastomer-loaded arm assembly housings adapted to affix said right arm assembly and said left arm assembly to said U-shaped bracket, each said arm assembly housing with a projecting finger to retain elongated resilient elastomer members between affixed right arm assembly housing and affixed left arm assembly housing, said resilient elastomer member providing a resilient range of motion of at least 80° backward for each arm assembly, (j) a cushion roller pad assembly slidably mounted on said support carrier member wherein position of said cushion roller pad assembly is lower than said U-shaped bracket on said support carrier member, (k) means for affixing said cushion roller pad assembly to said support carrier member, said means comprising a bracket and a backrest carrier, (l) said support carrier member adapted to be locked in position on said elongated upright support member as required by the user, (m) said support carrier member wherein said support carrier has an adjusting finger and adjusting knob to lock said support carrier member in position on said elongated upright support member.

2. The exercise device of claim 1 wherein arms of said right arm assembly and of said left arm assembly have hand grips angled at 45° downward, plus or minus 5°.

3. The exercise device of claim 1 wherein said cushion roller pad assembly comprises a foam roller pad.

4. The exercise device of claim 1 wherein said coiled spring assembly comprises a compression spring, a push block, a threaded shaft, a nut block, a back plate, a pivot lever, a pivot axis bolt, an engaging member bolt, and a spring compression adjustment knob.

5. The exercise device of claim 1 wherein material of said resilient elastomer members between said affixed right arm assembly housing and said affixed left arm assembly housing is selected from the group consisting of neoprene rubber, butyl rubber, silicone rubber, and any synthetic elastomer suitable for the resilient requirements of providing a suitable resilient range of motion backward of at least 80° for each said arm assembly.

6. The exercise device of claim 1 wherein said support carrier member is slidably mounted on said elongated upright support member and said backrest carrier is slidably mounted and said U-bracket is affixed on said support carrier member.

7. A posture correction exercise device for strengthening the spinal erectors, and the mid-trapezious, rhomboid and posterior deltoid muscles to correct kyphosis-lordosis conditions including:

(a) an inclined main frame having a rearward end and a forward end comprising a single elongated structural member with cross bars and an upright bracket mounted on the rearward end of said elongated structural member, (b) a seat cushion having a rearward end and a forward end affixed to said inclined main frame wherein position of said rearward end of said seat cushion is spaced apart from said upright bracket on said inclined main frame, (c) an elongated upright support member having a lower end extending generally upward from said upright bracket mounted on the rearward end of said elongated structural member to an upper end, (d) a resistance means for resistance of said elongated upright support member against backward movement by the user's body, (e) a mounting means for affixing said elongated upright support member to said upright bracket mounted on the rearward end of said elongated structural member, said mounting means comprising an axis mounting and a pivot axis bolt, (f) a support carrier member with a locking finger and adjusting knob slidably mounted on said upper end of said elongated upright support member, (g) an arm assembly bracket mounted on said support carrier member, said arm assembly bracket being a U-shaped bracket adapted to seat arm assembly housings within arms of said U-shaped bracket, (h) a right arm assembly and a left arm assembly, each arm of each said arm assembly shaped in accordance with the user's arms, (i) two arm assembly housings adapted to affix each said right arm assembly and said left arm assembly to said U-shaped bracket, each said arm assembly having resistance means against backward rotation of user's arms, (j) a cushion roller pad assembly slidably mounted on said support carrier member wherein position of said roller pad assembly is lower than said U-shaped bracket on said support carrier member, (k) means for affixing said cushion roller pad assembly to said support carrier member, said means comprising a bracket and a backrest carrier, (l) said support carrier member adapted to be locked in position on said elongated upright support member as required by the user, (m) said support carrier member wherein said support carrier member has an adjusting finger and adjusting knob to lock said support carrier member in position on said elongated upright support member.

8. The posture correction exercise device of claim 7 wherein said resistance means for said upright support member against backward movement of the user's body comprises a coil spring assembly having a rearward end and a forward end extending generally within said single elongated structural member from said forward end of said single elongated structural member to said rearward end so that said rearward end presses against end of said elongated upright support member to cause resistance against backward movement of said elongated support upright support member on said axis mounting.

9. The posture correction device of claim 7 wherein said two arm assembly housings adapted to mount said right arm assembly and said left arm assembly to said U-shaped bracket wherein each said arm assembly housing has a projecting finger to retain elongated resilient elastomer members, said elastomer members comprising said means of resistance against backward rotation of user's arms.

10. The posture correction device of claim 7 wherein said resistance means against backward rotation of user's arms comprises elongated resilient elastomer members between each said arm assembly wherein material of said elongated resilient elastomer members is selected from the group consisting of neoprene rubber, butyl rubber, silicone rubber, and any suitable synthetic elastomer, said resilient elastomer members providing a resilient range of motion of at least 80° backward for each arm assembly.

11. The posture correction device of claim 7 wherein said posture correction device has removable locking pins in the arm housing assemblies, in the base of the elongated upright support member and in the mountings of the support legs to the inclined main frame wherein on removable of the locking pins, the posture correction device folds flat for storage.

* * * * *